United States Patent [19]

Seki

[11] Patent Number: 4,717,061

[45] Date of Patent: Jan. 5, 1988

[54] BUTTON FEEDER FOR BUTTON APPLICATOR

[75] Inventor: Fumio Seki, Toyama, Japan

[73] Assignee: Yoshida Kogyo K. K., Tokyo, Japan

[21] Appl. No.: 925,077

[22] Filed: Oct. 30, 1986

[30] Foreign Application Priority Data

Oct. 31, 1985 [JP] Japan ..... 60-166701[U]

[51] Int. Cl.[4] ..... A41H 37/10

[52] U.S. Cl. ..... 227/119; 112/113

[58] Field of Search ..... 29/432.1, 719; 112/113; 227/117, 118, 119, 120, 155

[56] References Cited

U.S. PATENT DOCUMENTS 3,815,805 6/1974 Beneteau ..... 227/119
4,427,146 1/1984 Seki ..... 227/119
4,615,473 10/1986 Taga ..... 227/119 X

FOREIGN PATENT DOCUMENTS 52-28453 3/1976 Japan .
56-85407 7/1981 Japan .

*Primary Examiner*—Paul A. Bell
*Attorney, Agent, or Firm*—Hill, Van Santen, Steadman & Simpson

[57] ABSTRACT

A button feeder feeds a button to a button applicator which applies the button to a garment fabric piece. The button feeder has a feed guide, a first side guide member having a substantially wedge-shaped groove, and a second side guide member having a wall confronting the wedge-shaped groove. The first side guide member includes a first guide element fixed to the base and a second guide element movably mounted on the first guide element for movement toward and away from the first guide element, the wedge-shaped groove being defined between the first and second guide elements. The second guide element is normally urged resiliently toward the first guide element. When the button is fed by the button feeder, its circular head tends to be wedged into the wedge-shaped groove, which is then spread by the movement of the second guide element away from the first guide element to allow the circular head to be smoothly moved without undue frictional resistance.

5 Claims, 10 Drawing Figures

BUTTON FEEDER FOR BUTTON APPLICATOR

BACKGROUND OF THE INVENTION

1. Field of the Invention:

The present invention relates to a button feeder for feeding buttons such as snap buttons, hook buttons, ornamental buttons, or the like to a button applicator for attaching such buttons to garment fabric pieces.

2. Description of the Prior Art:

Japanese Laid-Open Utility Model Publication No. 56-85407 published July 11, 1981 discloses an automatic button applicator having a lower die unit with a die and an upper die unit with a punch. The button applicator is equipped with a button feeder for feeding buttons one by one from a first hopper to the lower die unit. Button attachments are also fed one by one by another feeder from a second hopper to the upper die unit. With a garment fabric piece disposed between the upper and lower die units, the punch is moved toward the die to forcibly join the button and the button attachment together by staking on the garment fabric piece.

Where an ornamental button with characters and/or figures on its face is to be attached to a fabric piece, the button is required to be oriented in a desired direction at all times when it is fed to a button applicator. A known button feeder is designed to supply such a button to a lower die unit while the button is being directed as desired.

For example, as shown by Japanese Laid-Open Patent Publication No. 52-28453 published Mar. 8, 1976, a guide member having a wedge-shaped groove and another guide member having a vertical wall are disposed in confronting relation on a base block, thus defining a button feed path receptive of the circular head of a button. When the button is fed along the button feed path by means of a pusher, the button is rotated about its own axis in one direction because the circular button head undergoes greater frictional resistance imposed by the wedge-shaped groove than by the vertical wall. The button has forks on its back which engage confronting edges of the guide members to orient the button while it is being fed along the button feed path.

When the button travels along the button feed path, the button tends to be subjected to more and more frictional resistance to its movement since the circular head thereof is progressively forced into the wedge-shaped groove due to rotation of the button about its own axis.

SUMMARY OF THE INVENTION

It is an object of the present invention to provide a button feeder capable of feeding buttons smoothly to a button applicator without increasing frictional resistance to movement of the buttons.

According to the present invention, a first side guide member of a feed guide includes a first guide element fixed to a base and a second guide element movably mounted on said first guide element for movement toward and away from said first guide element, said first and second guide elements jointly defining a wedge-shaped groove. The wedge-shaped groove cooperates with the base and a wall of a second side guide member of the feed guide in defining a button feed path for passage therethrough of a button toward a button applicator. The second guide element is normally urged resiliently toward the first guide element. When the circular head of the button is forced into the wedge-shaped groove while the button is being fed along the button feed path, the second guide element is moved away from the first guide element, thereby spreading the wedge-shaped groove to allow smooth movement of the circular head of the button along the button feed path.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
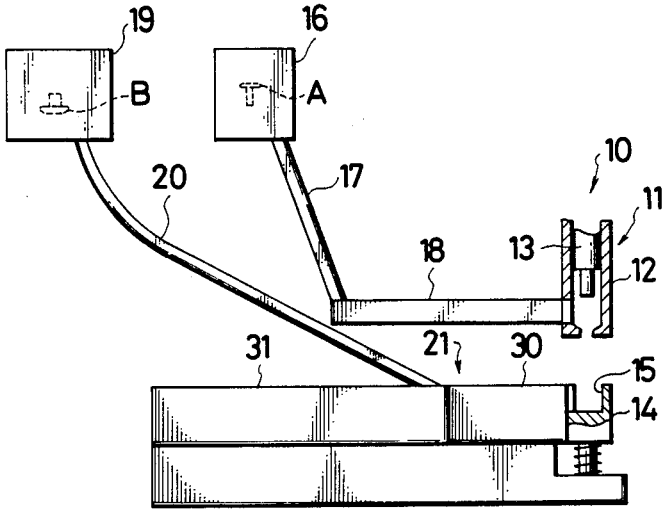
FIG. 1 is a side elevational view of a button applicator.

FIG. 1 shows a button applicator, generally designated by the reference numeral 10, including a button attaching assembly 11 comprising an upper die unit 12 having a punch 13 which is vertically movable by a vertical actuator mechanism (not shown), and a lower die unit 14 having a die 15 disposed below the upper die unit 12 in vertical alignment therewith. A first hopper 16 which contains a number of button attachments A has an outlet connected by a first chute 17 to a feeder 18 coupled to the upper die unit 12. A number of buttons B are contained in a second hopper 19 with its outlet joined by a second chute 20 to a button feeder 21 which is connected to the lower die unit 14. The first and second hoppers 16, 19 are arranged to successively deliver the button attachments A and the buttons B, each one by one, to the first and second chutes 17, 20, respectively, as disclosed in Japanese Laid-Open Patent Publication No. 56-85407, for example.

Figure 2:
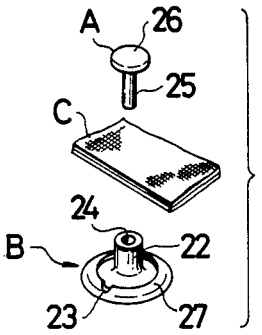
FIG. 2 is an exploded perspective view showing a button and a button attachment to be attached to a fabric piece.

As shown in FIG. 2, each of the buttons B has a circular head 27 bearing characters, figures, or the like on its face and a joint stud 22 projecting from the back thereof. The circular head 27 has a recess 23 defined in a peripheral edge of the back thereof. The joint stud 22 has a central hole 24 therein. Each of the button attachments A has a pin 25 projecting from a circular base 26. The button 21 can be attached to a garment fabric piece C by inserting the pin 25 through the garment fabric piece C into the central hole 24 of the joint stud 22, and pressing the button attachment A toward the button B.

This can be effected by supplying one button attachment B into the upper die unit 12 beneath the punch 13, one button A into the lower die unit 14 on the die 15, placing the garment fabric piece C between the upper and lower die units 12, 14, and finally moving the upper die unit 12 toward the lower die unit 14 until the inserted pin 25 is deformed in the hole 24.

Figure 3:
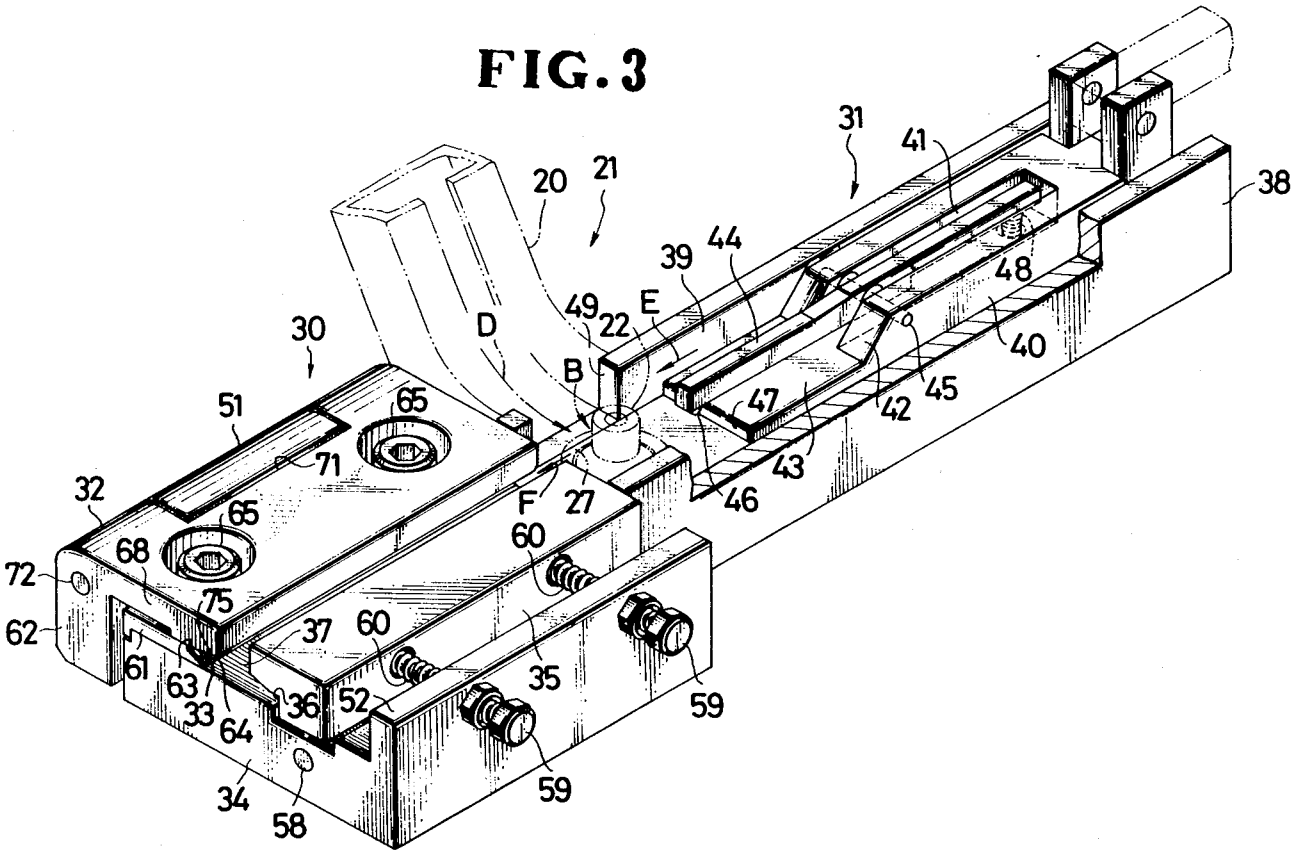
FIG. 3 is a perspective view of a button feeder according to the present invention.

As shown in FIG. 3, the button feeder 21 generally comprises a feed guide 30 positioned adjacent to the lower die unit 14 and a pusher unit 31 coupled to the feed guide 30. The feed guide 30 includes a side guide member 32 having a groove 33 of a substantially wedge-shaped cross section and disposed on an upper surface of a base 34 along one side thereof. The feed guide 30 also includes another side guide member 35 having a vertical wall 36 and disposed on the upper surface of the base 34 along an opposite side thereof. The groove 33 and the vertical wall 36 confront each other across a feed path 37 defined longitudinally between the side guide members 32, 35 over the upper surface of the base 34 for passage therethrough of the circular head 27 of the button B.

The pusher unit 31 includes a pusher body 38 having an upwardly opening guide channel 39 and an elongate pusher 40 longitudinally slidably disposed in the guide channel 39. The pusher 40 has a slot 41 defined in a rear portion thereof and terminating at a slanted edge 42, from which a thin lower plate 43 extends toward the feed guide 30. A finger 44 is pivotably mounted by a pin 45 on the pusher 40 for vertical swinging movement about the pin 45. The finger 44 has a rear portion disposed in the slot 41 and a front portion lying on the thin lower plate 43. The front end of the finger 44 has a downward projection 46 positioned beyond a frontal edge 47 of the thin lower plate 43. The finger 44 is normally urged to turn counterclockwise (FIG. 3) about the pin 45 under the resiliency of a spring 48 disposed in the slot 41 and engaging the rear end of the finger 44, so that the projection 46 is biased downwardly in front of the frontal edge 47. The pusher 40 is coupled at its rear end to an actuator (not shown) such as a cylinder or a reciprocating link mechanism. The pusher body 38 has a side recess 49 defined in one side wall thereof. The second chute 20 is coupled transversely to the pusher body 38 at the side recess 49 to allow the button B to be fed from the second chute 20 through the side recess 49 into the guide channel 39.

Figure 4:
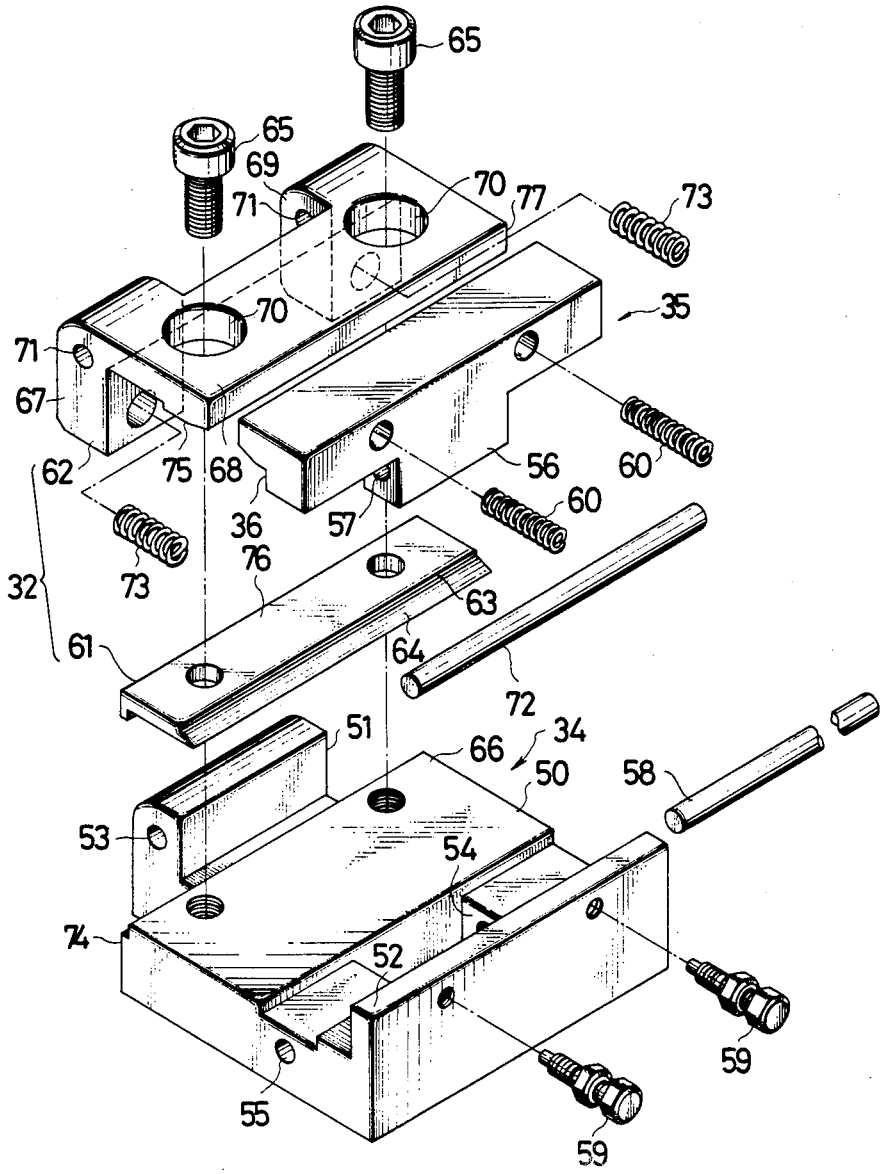
FIG. 4 is an exploded perspective view of the feed guide shown in FIG. 3.
Figure 5:
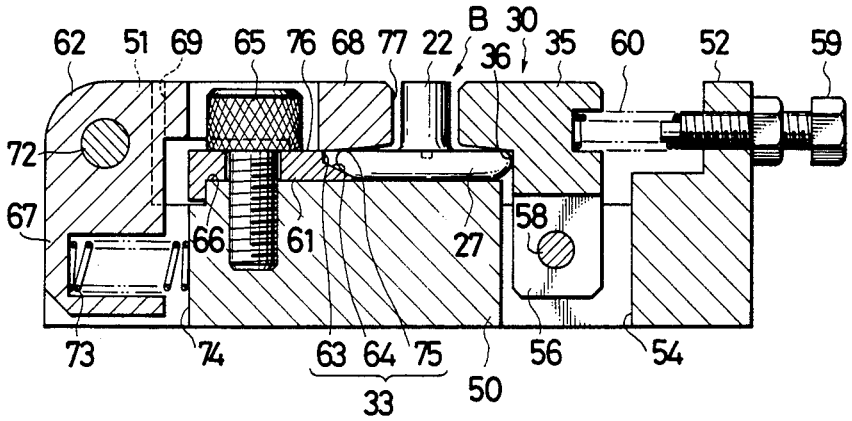
FIG. 5 is a transverse cross-sectional view of the feed guide shown in FIG. 4.
Figure 6:
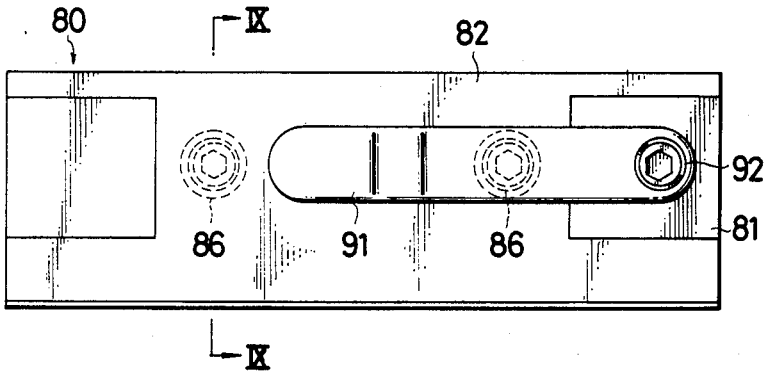
FIG. 6 is a plan view of a side guide member of a feed guide according to another embodiment of the present invention.
Figure 7:
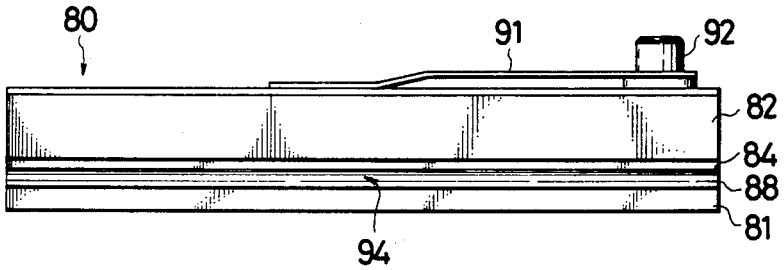
FIG. 7 is a side elevational view of the side guide member illustrated in FIG. 6.
Figure 8:
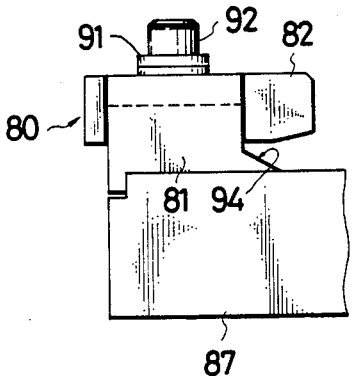
FIG. 8 a front elevational view of the side guide member of FIG. 6.
Figure 9:
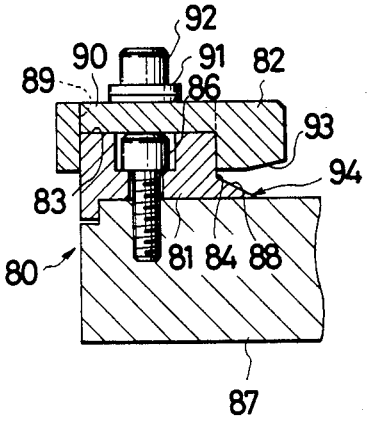
FIG. 9 is a cross-sectional view taken along line IX—IX of FIG. 6.
Figure 10:
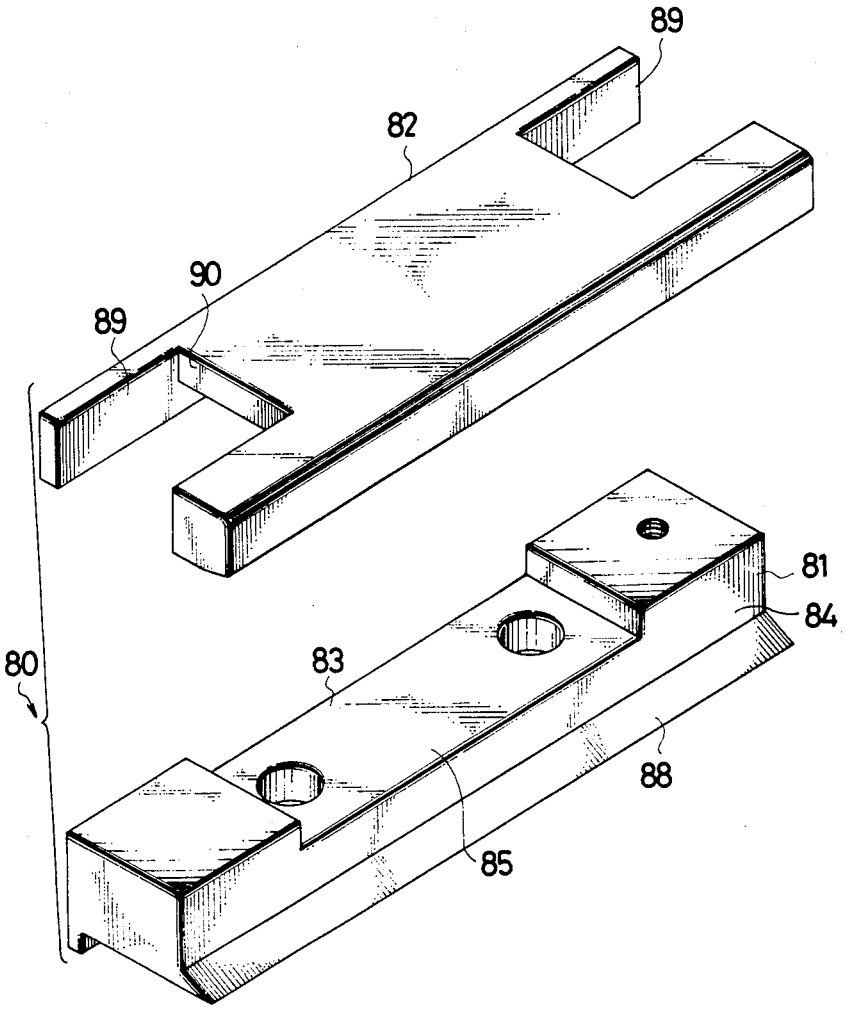
FIG. 10 is an exploded perspective view of the side guide member shown in FIG. 6.

As shown in FIGS. 4 and 5, the base 34 of the feed guide 30 comprises a base body 50 that is substantially in the form of a rectangular parallelepiped, the base body 50 having an integral attachment leg 51 on one side thereof and an upright member 52 on the opposite side thereof. The attachment leg 51 has a longitudinal through hole 53 of a circular cross section. The base body 50 also has a vertical opening 54 defined adjacent to the upright member 52, and a longitudinal through hole 55 of a circular cross section which extends through the opening 54. The side guide member 35 includes a downwardly extending arm 56 having a longitudinal through hole 57 of a circular cross section and disposed in the vertical opening 54. The side guide member 35 is swingably supported on the base body 50 by means of a pin 58 of a circular cross section extending through the holes 55, 57. A pair of screws 59 is threaded through the upright member 52. The side guide member 35 is normally urged to turn counterclockwise (FIG. 5) about the pin 58 under the resilient forces of two compression coil springs 60 acting between the side guide member 35 and the screws 59.

The side guide member 32 comprises a first guide element 61 and a second guide element 62. The first guide element 61 is in the form of a thin plate having, on one side thereof, an upper vertical surface 63 and a lower slanted surface 64. The first guide element 61 is fixed by a pair of screws 65 in flatwise face-to-face engagement with the upper surface 66 of the base body 50 along one side thereof near the leg 51.

The second guide element 62 has a substantially L-shaped cross-section composed of a vertical portion 67 and a horizontal portion 68. The vertical portion 67 has a vertical recess 69 defined therethrough at a corner of the horizontal portion 68. The horizontal portion 68 has a pair of holes 70 through which the respective screws 65 extend with clearance. The vertical portion 67 has a longitudinal through hole 71 extending through the vertical recess 69. With the leg 51 received in the vertical recess 69, the second guide element 62 is swingably mounted on the base body 50 by a pin 72 extending through the holes 53, 71. Two compression coil springs 73 act between the vertical portion 67 and a side surface 74 of the base body 50 for normally urging the second guide element 62 to turn clockwise (FIG. 5) about the pin 72 for thereby bringing the lower surface 75 of the horizontal portion 68 into abutment against the upper surface 76 of the first guide element 61. Under this condition, the lower surface 75 of the horizontal portion 68 and the vertical and slanted surfaces 63, 64 of the first guide element 61 jointly define the wedge-shaped groove 33. The horizontal portion 68 has a side edge 77 facing the side guide member 35.

In operation, the button B passes down the second chute 20 through the side recess 49 into the guide channel 39 in the direction of the arrow D (FIG. 3) with the joint stud 22 extending upwardly. Then, the pusher 40 is moved in the direction of the arrow E to cause the frontal edge 47 thereof to engage and push the circular head 27 of the button B in the direction of the arrow F into the feed path 37. At this time, the downward projection 46 of the finger 44 engages the back of the circular head 27, slightly turning the finger 44 clockwise about the pin 45 against the resiliency of the spring 48.

When the button B is pushed into the feed path 37, the circular head 27 is brought into contact with the surfaces 63, 64, 75 of the wedge-shaped groove 33 and the vertical wall 36, as shown in FIG. 5 at diametrically opposite portions of the circular head 27. Since the circular head 27 undergoes greater frictional resistance imposed by the wedge-shaped groove 33 than by the vertical wall 36, the button B is rotated about its own axis in one direction by the pusher 40 while it is being fed along the feed path 37. The button B is rotated until the projection 46 on the finger 44 is received in the recess 23 defined in the back of the circular head 27. When the projection 46 engages in the recess 23, the button B is prevented from being rotated about its own axis and is directed in a desired orientation. The button B which is thus oriented as desired is delivered by the pusher 40 into the lower die unit 14 and set on the die 15.

While the button B is being fed along the feed path 37, the circular head 27 as it rotates tends to be progressively forced into the wedge-shaped groove 33, which is then spread. More specifically, the horizontal portion 68 of the second guide element 62 is pushed upwardly by the circular head 27 to cause the second guide element 62 to turn counterclockwise (FIG. 5) about the pin 72 against the resilient forces of the springs 73. When the joint stud 22 engages the side edge 77 of the horizontal portion 68, the circular head 27 is prevented from farther entering the wedge-shaped groove 33 and hence from larger frictional resistance applied by the wedge-shaped groove 33. Therefore, the button B is fed smoothly along the feed path 37 without being stuck in the wedge-shaped groove 33.

FIGS. 6 through 10 illustrate a side guide member 80 according to another embodiment of the present invention. The side guide member comprises a first guide element 81 and a second guide element 82. The first guide element 81 has an upwardly opening recess 83 defined in an upper surface thereof at a longtidinally central area, the recess 83 having a depth which is about half the height of a vertical surface 84. The recess 83 has a bottom 85 through which screws 86 extend threadedly into a base 87 to secure the first guide element 81 to the base 87. The first guide element 81 has a slanted surface 88 extending obliquely downwardly from the vertical surface 84. The second guide element 82 has a pair of recesses 89 defined vertically through opposite longitudinal end portions thereof. The upper portions of the first guide element 81 which are located one on each side of the recess 83 are snugly fitted respectively in the recesses 89 in the second guide element 82. The second guide element 82 thus has a longitudinal central portion 90 between the recesses 89 which is snugly fitted in the recess 83. The second guide element 82 combined with the first guide element 81 is prevented from moving longitudinally and transversely with respect to the first guide element 81, but is movable vertically relatively thereto. A leaf spring 91 has one end secured by a screw 92 to one longitudinal end of the first guide element 81 and an opposite end resiliently held against the upper surface of the central portion 90 of the second guide element 82. The second guide element 82 has a lower surface 93 facing toward the base 87 and cooperating with the vertical and slanted surfaces 84, 88 in defining a substantially wedge-shaped groove 94 for receiving the circular head 27 (FIG. 2) of the button B.

When the circular head 27 is forced into the wedge-shaped groove 94, the second guide element 82 is moved upwardly against the resiliency of the leaf spring 91 thereby to spread the wedge-shaped groove 91.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A button feeder, for feeding a button having a circular head to a button applicator, comprising:

a feed guide including a base, a first side guide member mounted on said base and having a substantially wedge-shaped groove, and a second side guide member mounted on said base and having a wall confronting said wedge-shaped groove, said base, said wedge-shaped groove, and said wall jointly defining a button feed path;

said first side guide member including a first guide element fixed to said base and a second guide element linearly movably mounted on said first guide element for movement toward and away from said first guide element, said wedge-shaped groove being defined between said first and second guide elements;

resilient means comprising a leaf spring acting between said second guide element resiliently toward said first guide element; and a pusher unit coupled to said feed guide for delivering the button into said button feed path.

2. A button feeder according to claim 1, said leaf spring having one end secured to said first guide element and an opposite end resiliently held against said second guide element.

3. A button feeder, for feeding a button having a circular head to a button applicator, comprising:

a feed guide including a base, a first side guide member mounted on said base and having a substantially wedge-shaped groove, and a second side guide member mounted on said base and having a wall confronting said wedge-shaped groove, said base, said wedge-shaped groove, and said wall jointly defining a button feed path;

said first side guide member including a first guide element fixed to said base and a second guide element linearly movably mounted on said first guide element for movement toward and away from said first guide element, said wedge-shaped groove being defined between said first and second guide elements;

said second guide element having a lower surface, said first guide element having a vertical surface and a slanted surface extending obliquely downwardly from said vertical surface, said wedge-shaped groove being jointly defined by said lower surface, said vertical surface, and said slanted surface;

resilient means acting between said second guide element resiliently toward said first guide element; and a pusher unit coupled to said feed guide for delivering the button into said button feed path.

4. A button feeder, for feeding a button having a circular head to a button applicator, comprising:

a feed guide including a base, a first side guide member mounted on said base and having a substantially wedge-shaped groove, and a second side guide member mounted on said base and having a wall confronting said wedge-shaped groove, said base, said wedge-shaped groove, and said wall jointly defining a button feed path;

said first side guide member including a first guide element fixed to said base and a second guide element angularly movably mounted on said first guide element for movement toward and away from said first guide element, said wedge-shaped groove being defined between said first and second guide elements;

said second guide element having a lower surface, said first guide element having a vertical surface and a slanted surface extending obliquely downwardly from said vertical surface, said wedge-shaped groove being jointly defined by said lower surface, said vertical surface, and said slanted surface;

resilient means acting between said second guide element resiliently toward said first guide element; and a pusher unit coupled to said feed guide for delivering the button into said button feed path.

5. A button feeder according to claim 4, said resilient means comprising a pair of compression coil springs.

* * * * *